US007776270B2

(12) United States Patent
Bondioli et al.

(10) Patent No.: US 7,776,270 B2
(45) Date of Patent: Aug. 17, 2010

(54) RESEALER OF TEST TUBES FOR CLINICAL ANALYSES FED FROM READY-TO-USE CONTAINERS OF SEALING TAPE

(75) Inventors: Maurizio Bondioli, Casalecchio di Reno (IT); Carlo Innocenti, Bologna (IT)

(73) Assignee: Ecocap's S.R.L., Casalecchio Di Reno (BO) (IT)

( * ) Notice: Subject to any disclaimer, the term of this patent is extended or adjusted under 35 U.S.C. 154(b) by 1149 days.

(21) Appl. No.: 11/410,316

(22) Filed: Apr. 25, 2006

(65) Prior Publication Data

US 2007/0248496 A1 Oct. 25, 2007

(51) Int. Cl.
*B65B 51/06* (2006.01)
*B65B 51/10* (2006.01)

(52) U.S. Cl. ..... 422/99; 156/69; 53/477

(58) Field of Classification Search ..... 215/232; 156/69; 53/477; 422/62, 63, 99
See application file for complete search history.

(56) References Cited

U.S. PATENT DOCUMENTS

| | | | | | |
|---|---|---|---|---|---|
| 4,127,925 | A | * | 12/1978 | Gaiser et al. | 29/430 |
| 4,156,416 | A | * | 5/1979 | Weisgerber et al. | 123/196 R |
| 4,952,777 | A | * | 8/1990 | Kogasaka | 219/243 |
| 5,972,713 | A | * | 10/1999 | Kuzuhara et al. | 436/125 |
| 2005/0161161 | A1 | * | 7/2005 | Sharp et al. | 156/353 |

* cited by examiner

*Primary Examiner*—Jill Warden
*Assistant Examiner*—Paul S Hyun
(74) *Attorney, Agent, or Firm*—Egbert Law Offices PLLC

(57) ABSTRACT

The invention relates to an automatic machine designed to reseal test tubes for clinical analyses with aluminum sealing tape housed in ready-to-use, cassette-type containers. The machine uses a heat-sealing process to apply a piece of aluminum foil, which will form the cap, over the mouth of the test tube, causing it to adhere to the edge of the test tube itself to achieve perfect resealing.

3 Claims, 7 Drawing Sheets

RESEALER OF TEST TUBES FOR CLINICAL ANALYSES FED FROM READY-TO-USE CONTAINERS OF SEALING TAPE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present industrial invention relates to an automatic machine designed to reseal test tubes for clinical analysis with aluminum caps obtained from a reel housed in a ready-to-use container. The cap for test tubes has been claimed by the same applicant under Italian patent BO2003A 000542.

BACKGROUND OF THE INVENTION

With particular reference to the present state of the art, test tubes containing already analyzed samples, without the original sealing cap or stopper, are collected in multiple supports which are hastily packed and placed in special cold storage compartments.

Fluid spillage from the test tubes is prevented solely by precarious coverings wrapped completely round the support. The risk of spillage or leaks in the event of an accident is thus very high, as is the risk of personnel being contaminated by samples.

To overcome such problems, a machine has been devised to reseal test tubes containing already analyzed samples.

This solution is useful both in that it allows the test tube container to be handled in complete safety and facilitates subsequent disposal of the test tubes themselves.

BRIEF SUMMARY OF THE INVENTION

The machine uses a heat-sealing process to apply a piece of aluminum foil, which will form the cap, over the mouth of the test tube, causing it to adhere to the edge of the test tube itself to achieve perfect resealing.

Another aim of the invention is to enable the aluminum foil to be fed to the machine rapidly, and in a manner that is easy for any operator, by means of a ready-to-use cassette-type container housing reels of aluminum tape.

This also avoids waste of aluminum tape, which, by its very nature, is difficult to handle.

These and other characteristics will now become more apparent upon reading the description of a simple embodiment of the invention, which is given for purely illustrative purposes and does not restrict the scope of this patent.

BRIEF DESCRIPTION OF THE SEVERAL VIEWS OF THE DRAWINGS

FIGS. 5,6,7 show an enlarged schematic view and a median cross section view of the cassette fitted in place on the machine and another, different cross section view of the cassette alone.

DETAILED DESCRIPTION OF THE INVENTION

Figure 1:
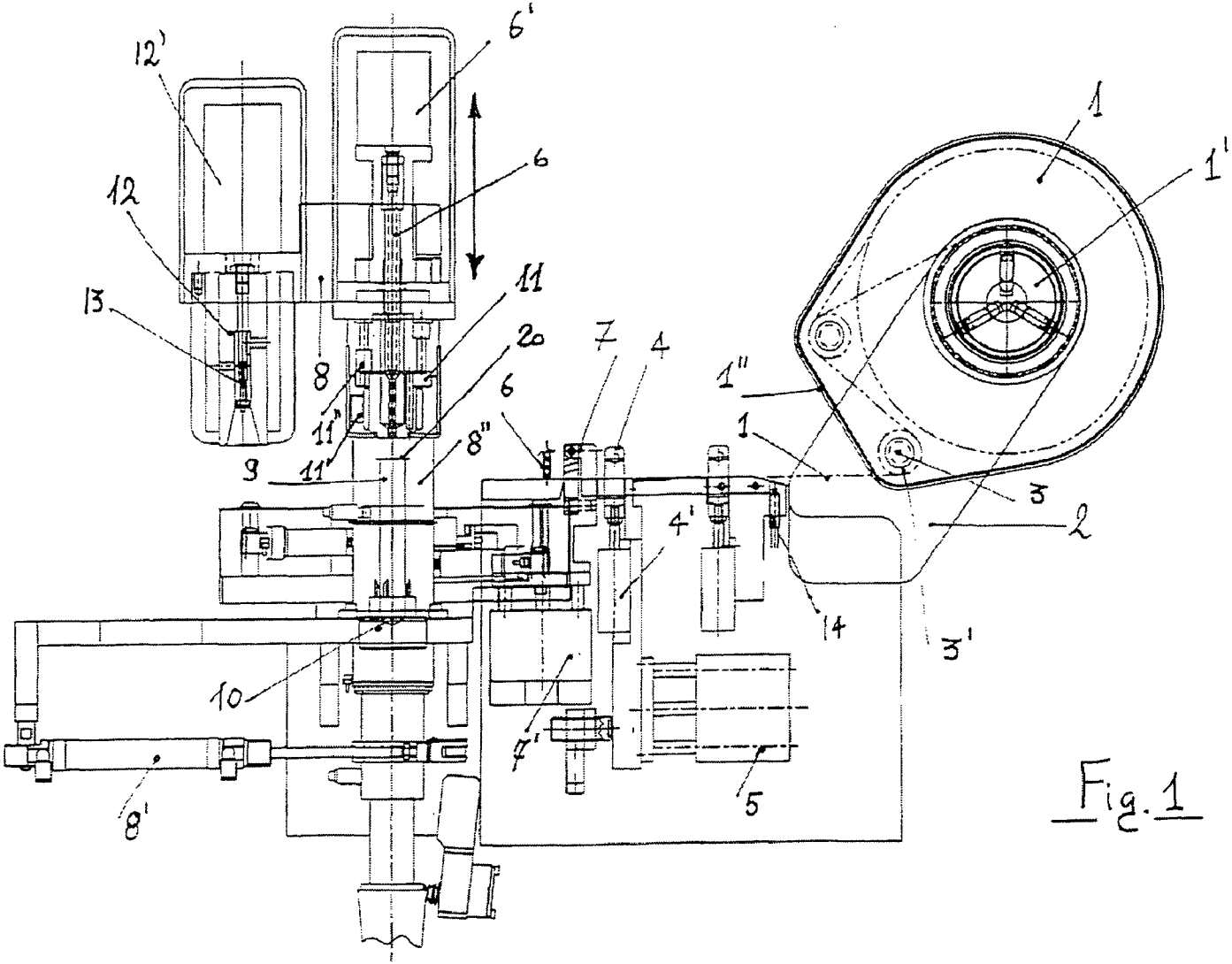
FIG. 1 shows a front schematic view of the machine.
Figure 2:
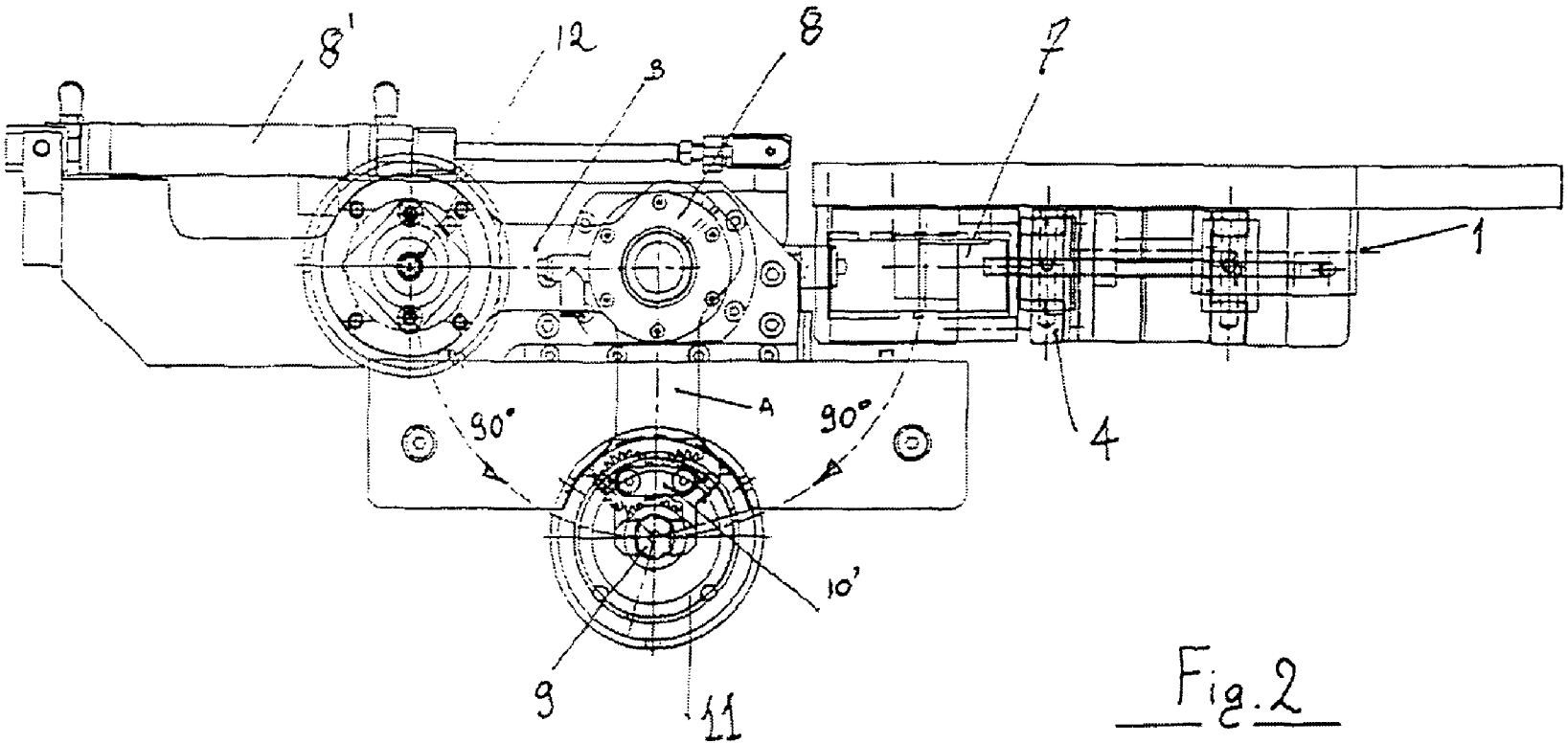
FIG. 2 shows a top plan view of the machine as viewed from above.
Figure 3:
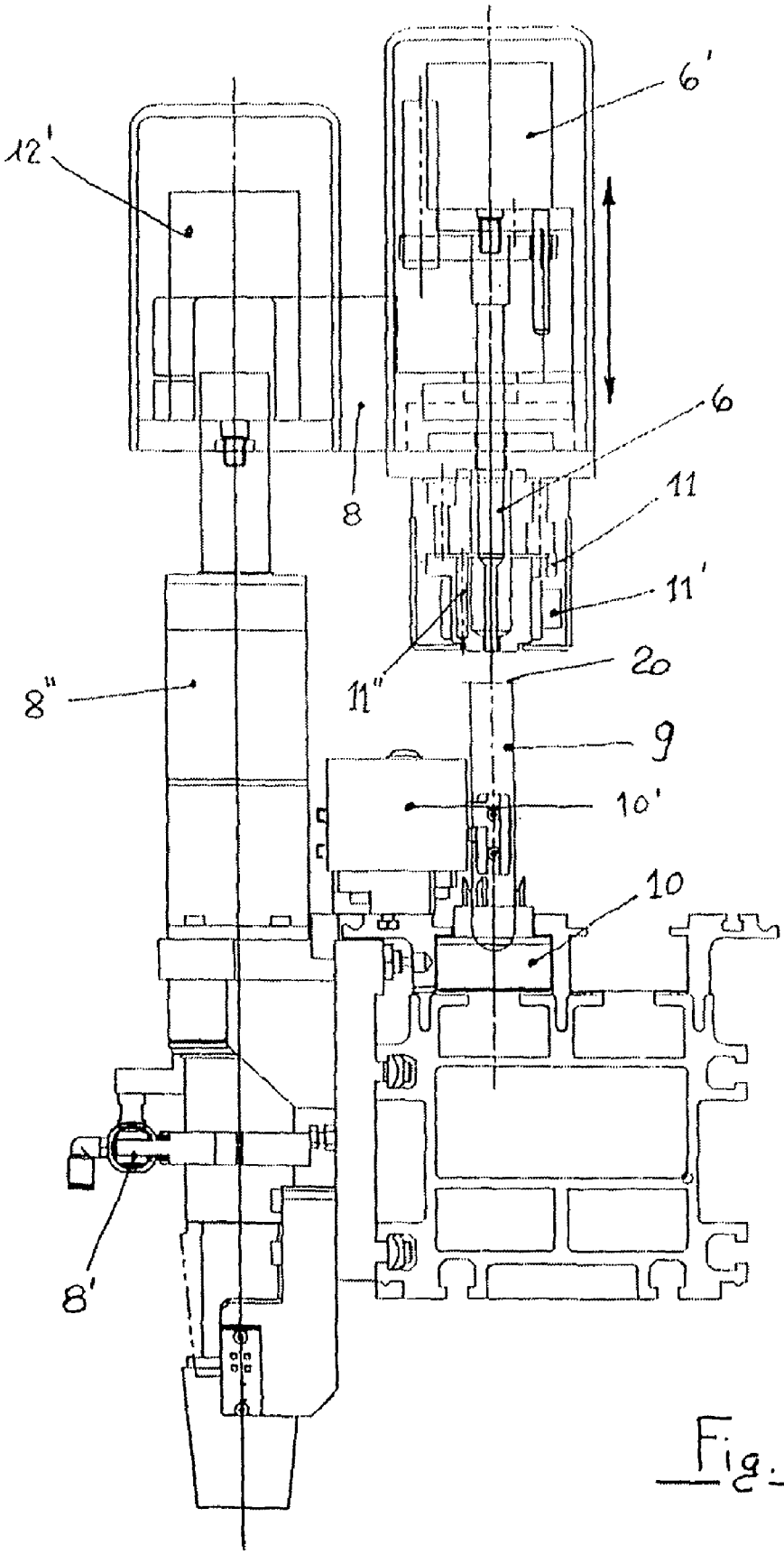
FIG. 3 shows a side schematic view of the machine.
Figure 4:
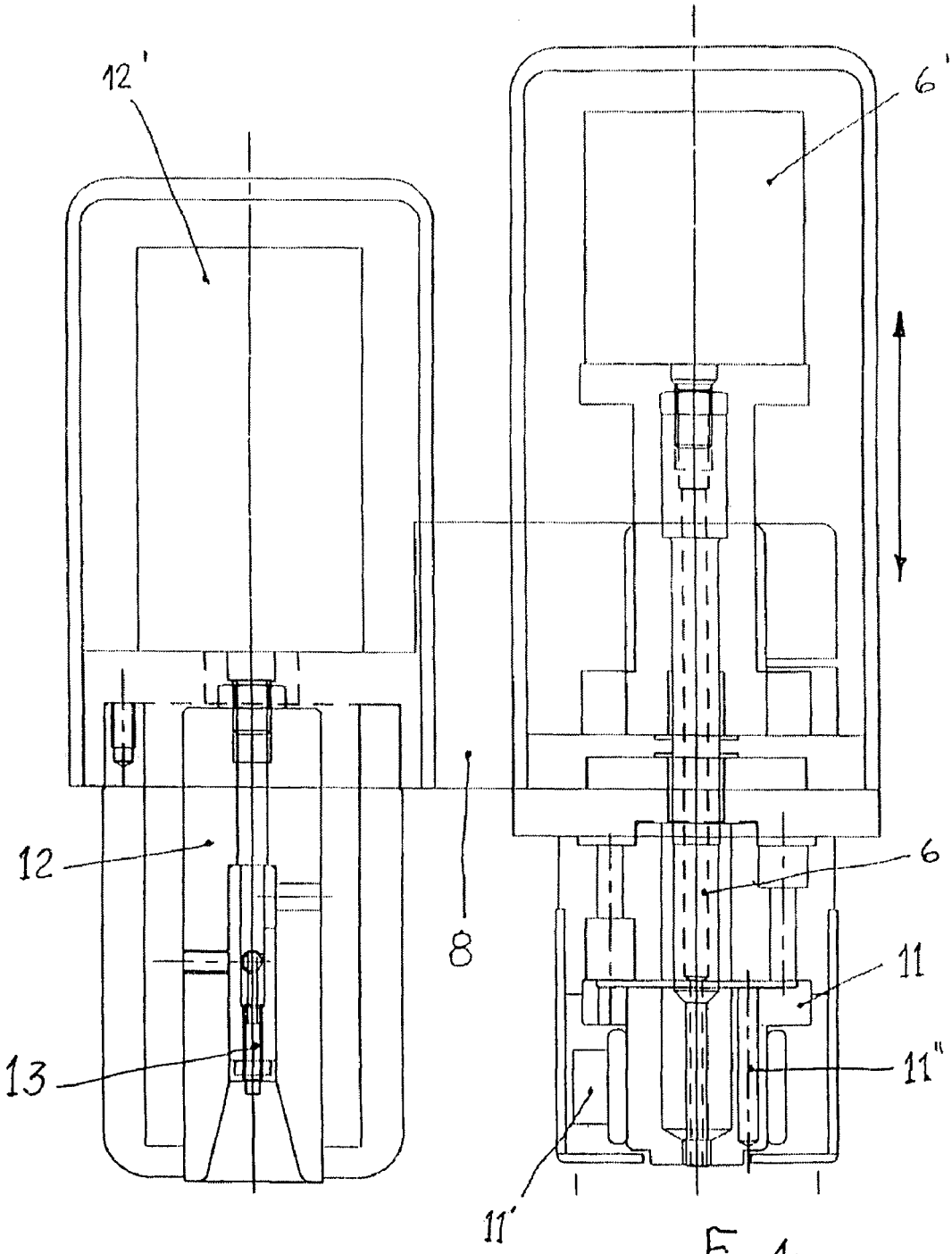
FIG. 4 shows another side schematic view of the machine.
Figure 4:
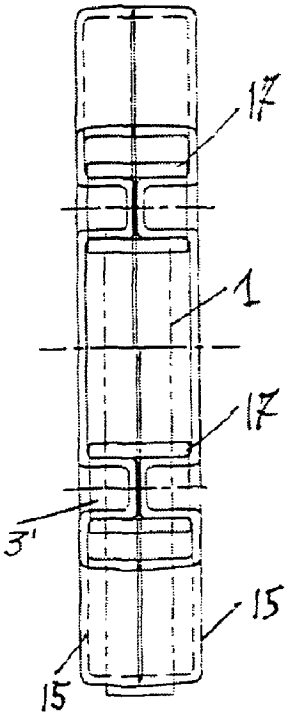
Figure 6:
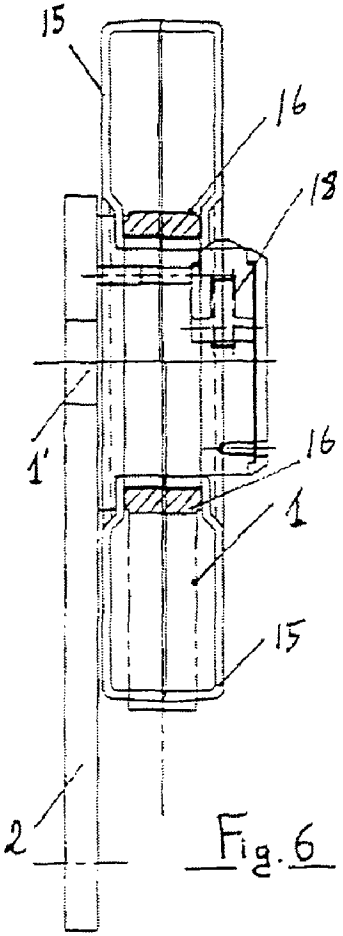
Figure 5:
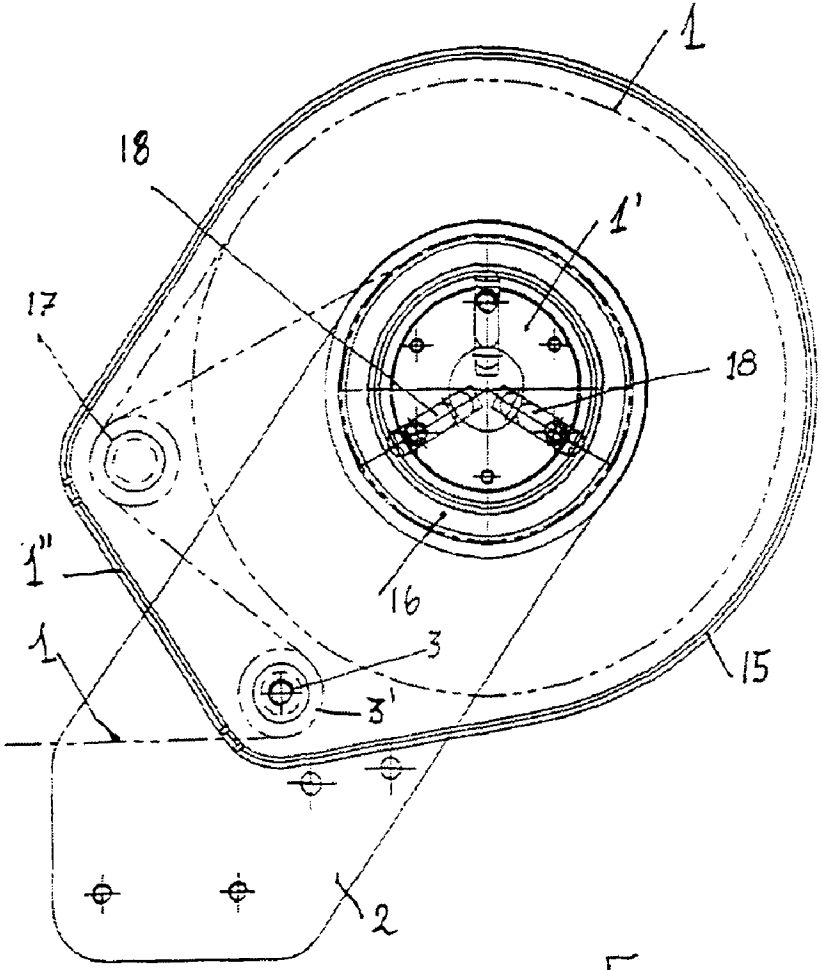
Figure 8:
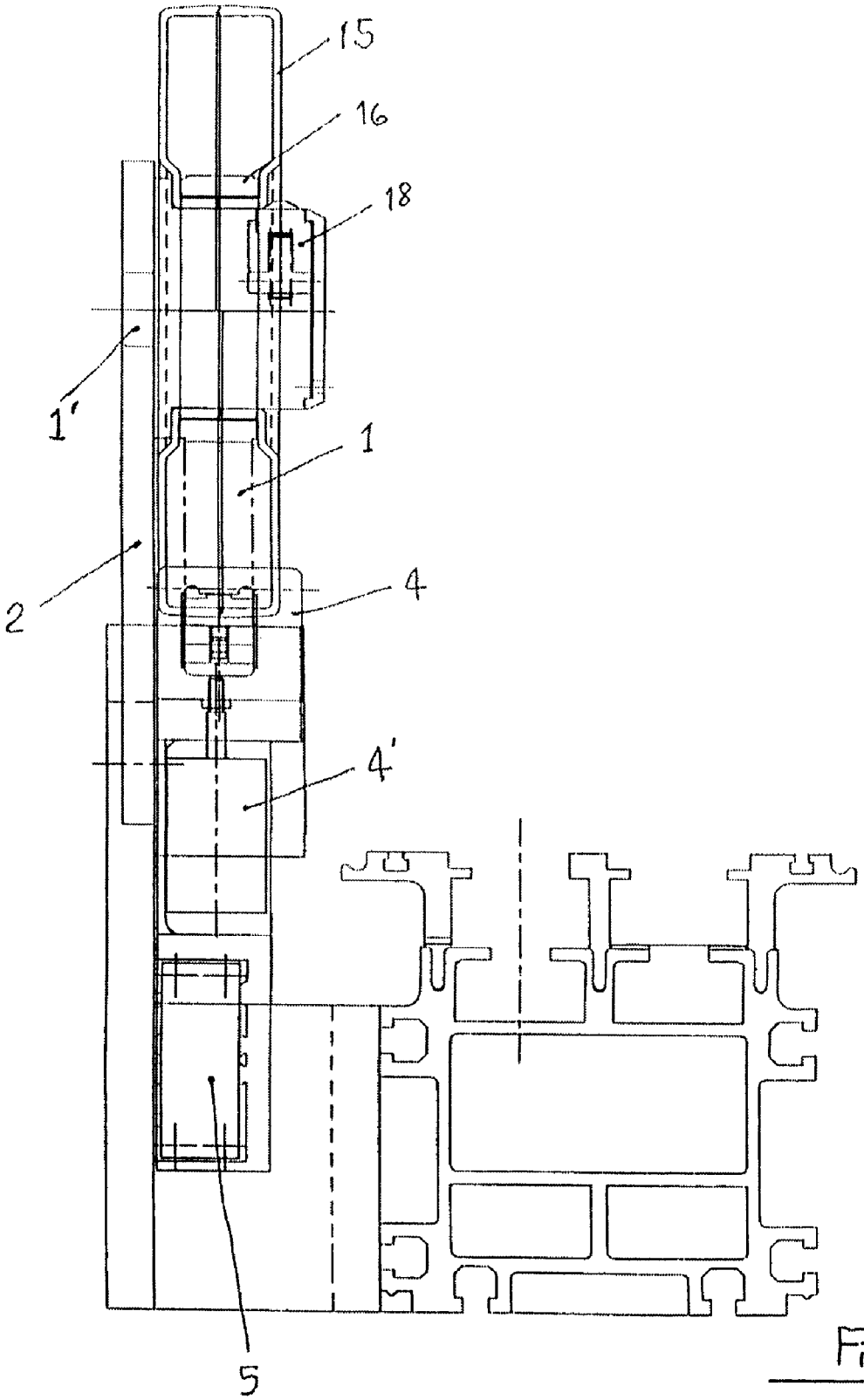
FIG. 8 shows a schematic view of the cassette fitted on the machine as viewed from the side.
Figure 9:
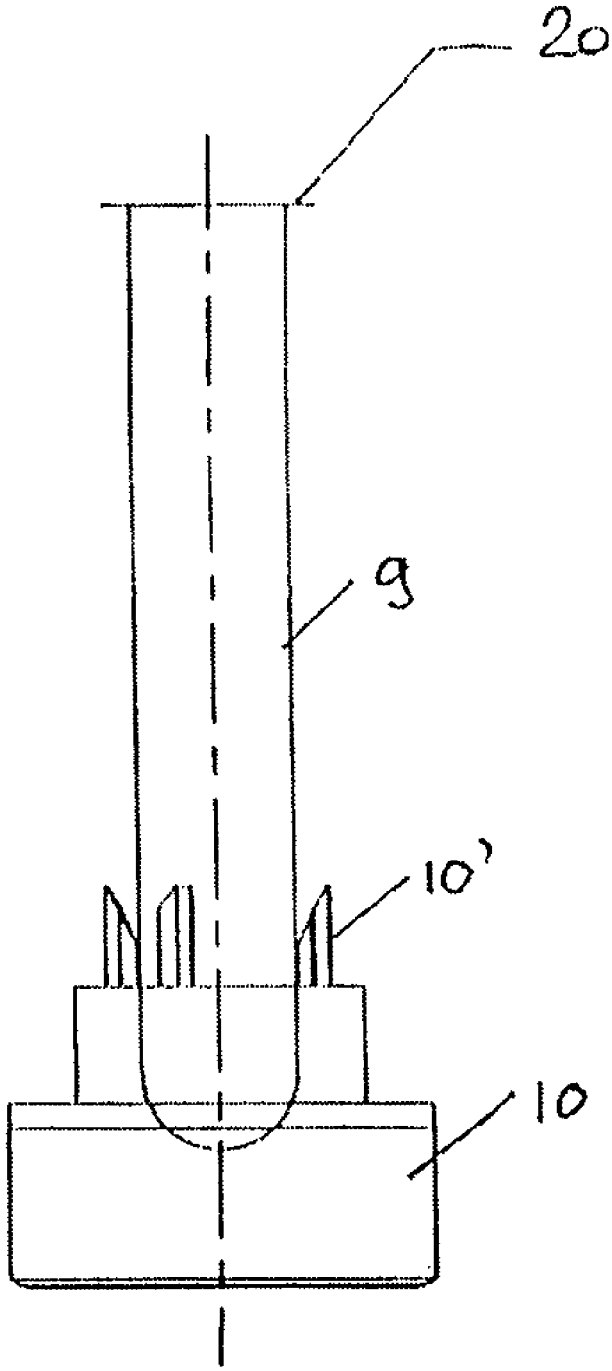
FIG. 9 shows a schematic view of the test tube to be sealed.

With reference to these figures, 1 indicates the reel of aluminum tape, 1' the self-centering and self-locking cassette holder present on the automatic machine, 1" the self-adhesive label that engages the end of the tape as it comes out of the cassette, 2 the resting surface serving as a guide for positioning the cassette together with the stud 3, which must engage the cavity 3' fashioned in the cassette itself. 4 indicates the tape feed gripper driven by cylinder 4' for gripping and by cylinder for conveying the tape. 6 indicates the vacuum-operated pick-up tube driven by cylinder 6' in the descent toward the tape. 7 indicates the blade for cutting the tape (1), driven by cylinder 7', which determines the pieces 20 to be used to form the resealing caps.

After picking up a cap (20), the tube (6) rises, while the dual head 8 driven by cylinder 8' rotates 90° in a clockwise direction to move into the sealing position.

9 indicates the test tube to be sealed, supported by an element 10 which holds it in place by means of a gripper 10'. The head (8) is moved vertically downward by cylinder 8" so that it may heat the cap (20) in contact with the test tube. 11 indicates the sealing device rigidly connected in A to the dual head (8), 11' the heating element and 11" the temperature probe.

When the sealing phase is completed, the head (8) rises and rotates 90° in an anticlockwise direction to get ready for a new cycle. This rotation enables the forming element 12, rigidly connected in B to the dual head (8), and driven by cylinder 12', to position itself on the test tube (9) and, as it is lowered, to adhere to the cap (20) so as to mould it around the outer surface of the test tube (9).

13 indicates a sensor that checks for the presence of a cap sealed onto the top of the test tube. The cap's absence will cause the cycle to be repeated. If the check is negative, a second time, an alarm will be triggered. 14 indicates a second sensor that checks for the presence of the aluminum foil to be fed to the machine. The absence or breakage of the sealing tape will bring the cycle to a stop and trigger an alarm. 15 indicates the two half-shells making up the cassette, which is shaped so as to house on the inside a reel of aluminum tape (1) wound around a plastic hub 16 and two take-up spools indicated by the number 17. The shape of the hole in the center of the cassette (15) is such as permit the cassette itself to be fitted onto the reel holder (1'). The spring-operated locking teeth 18 are compressed on entry, facilitated by the shape of the central hole of the cassette, and once the latter has been fitted they expand to lock the cassette containing the reel in place. Correct fitting of the cassette is assured by the stud (3) which, by engaging the cavity (3'), ensures that the cassette is correctly positioned on the machine.

The reel contained in the cassette is of a length such as to enable approximately 16000 test tubes to be sealed with an equal number of individual pieces. The machine counts up to 15000 cycles before giving a warning that the reel is about to run out. On reaching 16000 cycles the machine will stop and request the operator to replace the cassette.

In practice, the construction details, dimensions, materials, shape and other aspects of the invention may vary without departing from the scope of the present industrial patent. In fact, the invention thus conceived lends itself to numerous adaptations and variants, all falling within the realm of the inventive concept. In addition, all the elements may be replaced by other technically equivalent ones.

We claim:

1. A test tube resealer apparatus comprising:

a cassette formed of a pair of half-shells joined together, said cassette having a polymeric winding hub interior thereof, said cassette having a pair of take-up spools therein in spaced relation to said winding hub, said cassette having a through hole in a center thereof, said cassette having a cavity;

a reel of hot-melt lacquer-coated aluminum sealing tape, said reel positioned on said winding hub of said cassette, said tape extending from said reel and over a portion of each of said pair of take-up reels;

a reel holder having elastic locking teeth extending therefrom so as to engage said cassette at said through hole thereof, said reel holder having a stud extending therefrom so as to engage said cavity of said cassette, said cassette residing against a resting surface of said reel holder;

a feed gripper connected to a first cylinder, the feed gripper configured to grip said tape when said feed gripper is driven by said first cylinder, said feed gripper further connected to a second cylinder, said geed gripper configured to convey the tape when said feed gripper is driven by said second cylinder;

a cutting unit positioned downstream of said feed gripper, said cutting unit having a tube connected to a vacuum source, said tube connected to and driven by a third cylinder, said cutting unit further having a cutting blade connected to and driven by a fourth cylinder;

a dual head connected to a fifth cylinder configured to rotate said dual head 90 degrees in a clockwise direction or 90 degrees in a counter-clockwise direction, said dual head further connected to a sixth cylinder configured to move said dual head vertically;

a sealing device rigidly connected to said dual head, said sealing device having a heating element and a temperature probe;

a forming element rigidly connected to said dual head, said forming element being driven by a sixth cylinder and configured to move toward the test tube so as to mould the tape over an end of the test tube; and a gripper having an element suitable for supporting and gripping the test tube to be sealed, said gripper being cooperative with said sealing device and said forming element so as to cause the test tube to be closed with the tape.

2. The apparatus of claim 1, further comprising:

a first sensor downstream of said gripper, said first sensor configured to verify a presence of a sealed cap on the test tube; and a second sensor downstream of said gripper, said second sensor configured to verify a presence of aluminum foil.

3. The apparatus of claim 1, said reel being UV treated.

* * * * *